United States Patent [19]

van den Nieuwenhuizen et al.

[11] Patent Number: 4,772,822

[45] Date of Patent: Sep. 20, 1988

[54] HIGH-PRESSURE DISCHARGE LAMP HAVING ELECTRODES WOUND IN OPPOSITE SENSE

[75] Inventors: Hubertus C. M. van den Nieuwenhuizen; Gerardus M. J. F. Luijks, both of Eindhoven, Netherlands

[73] Assignee: U.S. Philips Corp., New York, N.Y.

[21] Appl. No.: 12,975

[22] Filed: Feb. 10, 1987

[30] Foreign Application Priority Data

Feb. 7, 1986 [NL] Netherlands ..... 8600293

[51] Int. Cl.[4] ..... H01J 61/06

[52] U.S. Cl. ..... 313/621; 313/631

[58] Field of Search ..... 313/621, 631, 622, 570

[56] References Cited

U.S. PATENT DOCUMENTS 3,502,929 3/1970 Richter ..... 313/570 X 4,320,322 3/1982 Rothwell, Jr. et al. ..... 313/621

FOREIGN PATENT DOCUMENTS 1591617 6/1981 United Kingdom ..... 313/621

*Primary Examiner*—David K. Moore

*Assistant Examiner*—Sandra L. O'Shea

*Attorney, Agent, or Firm*—Brian J. Wieghaus

[57] ABSTRACT

The high-pressure discharge lamp has oppositely arranged electrodes of wound tungsten wire. The electrodes are the mirror images of one another and are arranged in the mirror image orientations of one another. The electrodes are free from material favoring electron emission. The form and the mutual relation of the electrodes prevent the lamp from flickering during operation in a position in which a straight line through these electrodes is horizontal.

4 Claims, 2 Drawing Sheets

HIGH-PRESSURE DISCHARGE LAMP HAVING ELECTRODES WOUND IN OPPOSITE SENSE

BACKGROUND OF THE INVENTION

The invention relates to a high-pressure discharge lamp comprising a translucent lamp vessel sealed in a vacuum-tight manner containing an ionizable gas filling a pair of electrodes within the lamp vessel face each other and are connected to a respective current-supply conductor extending through the wall of the lamp vessel. The electrodes of the pair each have a wound wire of mainly tungsten and the distance between the wound wires being substantially equal to the distance between the electrodes.

Such a high-pressure discharge lamp is known from British patent specification No. 1,591,617.

The known lamp is intended to be operated in a position in which the discharge path, i.e. an imaginary straight line through the electrodes, is at least substantially horizontal. In the known lamp, the wound wire of each of the electrodes encloses a quantity of material favouring electron emission (emitter material). This material is sputtered during operation of the lamp. In order to prevent the material from being mixed with the ionizable gas filling or being deposited on the wall of the lamp vessel, the lamp has cavities which are recessed in the seals of the lamp vessel and in which the electrodes are arranged. The electrodes are deformed so that their end face is in line with the inner surface of the wall of the lamp vessel.

In lamps whose electrodes enclose emitter material, the discharge terminates on an electrode at the stage when this electrode is acting as the cathode at a point which is rich in emitter material. When the emitter material at this point becomes depleted, the discharge arc jumps to another point. The point at which the discharge arc terminates on an electrode at the cathode stage is therefore strongly influenced by the presence of emitter material. In emitterless electrodes, this influence is consequently absent.

When the point of termination of the discharge arc on an electrode jumps to another position, this may result in a variation of the value of the luminous flux emitted by the lamp.

If a high-pressure discharge lamp is operated in a position in which the discharge path is horizontal, the discharge arc shifts so as to be curved upwards under the influence of a flow of gas in the lamp vessel due to temperature differences. With comparatively wide lamp vessels, the discharge arc is curved more strongly than with comparatively narrow lamp vessels. The points of termination of the discharge arc on the electrodes are also shifted towards the upper side of the electrodes in a horizontal operating position. In lamps with emitterless electrodes, in contrast with lamps having electrodes with emitters, a stationary termination of the discharge arc on the electrodes may therefore be expected in a horizontal operating position.

However, it has been found that the lamps having emitterless electrodes, which are operated with the discharge path in a horizontal position at an alternating voltage at the current supply frequency, can exhibit substantial variations of the value of the luminous flux, which occur at the frequency of the alternating voltage. These variations become manifest as flickering of the lamp, which can be very annoying.

SUMMARY OF THE INVENTION

The invention has for its object to provide lamps of the kind described in the opening paragraph, in which flickering during operation in a horizontal operating position is avoided to a great extent.

According to the invention, this object is achieved in a lamp of the kind described in the opening paragraph in that the electrodes of the pair are at least substantially the mirror images of one another and are arranged at least substantially in the mirror image orientations of one another, and in that the electrodes are free from material favouring electron emission.

The invention is based on the recognition of the fact that during operation of an ordinary high-pressure discharge lamp with emitterless electrodes (not in accordance with the invention) in a horizontal operating position, the discharge arc terminates constantly on the end turn of both electrodes at the upper side. The discharge arc consequently has a stable position for a very long period. Therefore, flickering of the lamp is not due to the fact that the points of termination of the discharge arc jump to other positions, but is due to the fact that the electrical current through the lamp in first half cycles of the mains voltage differs from the electrical current in the second half cycles. With the difference in the electrical current through the lamp, the luminous flux of the lamp in first half cycles differs from that in the second half cycles.

The electrical current through the lamp depends upon the voltage across the lamp ($V_{1a}$), for which it holds that:

$$V_{1a}=V_{e1}+E\cdot L,$$

where $V_{e1}$ = the voltage drop for the cathode,

E = the electric field in the discharge,

L = the length of the discharge arc.

If L is constant, due to the fact that the discharge arc has a stable position, and if E is constant, due to the fact that no demixing occurs in the gas filling, variation in $V_{1a}$ must be due to the fact that $V_{e1}$ varies.

It has now been found that the voltage drop for the cathode ($V_{e1}$) in first half cycles differs from that in second half cycles due to the fact that the point at which the discharge arc termiates on the upper side of one electrode is not the same geometrically as the point on the other electrode at which the discharge arc terminates. Because the geometrical positions of the respective points of termination of the discharge arc on the two electrodes at the cathode stage are different, the temperatures of the electrodes at these points of termination will typically also be different.

The situation may be such that in an ordinary high-pressure discharge lamp having two identical emitterless electrodes wound from wire, in a given position during horizontal operation the discharge arc by chance terminates on one electrode at a point which is identical geometrically to the point of termination on the other electrode. However, if this lamp is rotated about a horizontal axis through the electrodes, for example as a result of the luminaire in which the lamp is arranged being directed further upwards, the points of termination of the discharge arc are shifted around the electrodes in order to permanently terminate on the upper side of the electrodes. As a result, in this ordinary lamp with identical electrodes, after this rotation the termination of the discharge arc occurs at geometrically different points of the electrodes and the lamp flickers, that is to say that for first half cycles of the mains voltage the lamp emits a higher (or lower)luminous flux than for the second half cycles. At a mains voltage frequency of 50 or 60 Hz, these variations can be observed by the eye. They are experienced by test persons as being annoying if the average luminous flux in one half cycle at 50 Hz is at least 2% larger than the average luminous flux in the other half cycle.

On the other hand, in the high-pressure discharge lamp according to the invention, the wound electrodes are not identical, but are the mirror images of one another. The wire of one electrode is wound, for example, in counter-clockwise direction and the wire of the other electrode is wound in clockwise direction so that the electrode end turns are mirror images of each other. Moreover, these electrodes are mounted in the lamp in such a manner that they are arranged at least substantially in the mirror image positions of one another. As a result, in every horizontal position of the lamp, there is on the upper side of one electrode end turn a point of termination for the discharge arc which is geometrically at least substantially identical to the point on the upper side of the other electrode end turn. This will be explained further with reference to the drawings and their description.

British patent specification No. 1,591,617 referred to earlier does not mention flickering of the lamp and the suppression of this phenomenon. The wound electrodes enclose emitter material and as a result geometric measures, such as taken in the lamp according to the invention, would not have had a favourable effect. The electrodes are deformed so they can be arranged in a respective recessed cavity so that the end face of each is in line with the inner surface of the wall of the lamp vessel. Neither the description nor the drawing show whether the electrodes are the mirror images of one another or whether they are wound in opposite senses. Even if it were assumed that they are the mirror images of one another it is not clear from the description and/or the drawing whether the electrodes are arranged in the mirror image positions of one another.

The wound wire of the electrodes of the lamp according to the invention can be helically wound, as the case may be with a constant pitch. The wound wire may have an unwound portion which constitutes a current-supply conductor and extends, for example, as far as into the wall of the lamp vessel. Another possibility consists of the wound wire gripping with one or more turns around a current-supply conductor.

The wound wire of the electrode can be surrounded by a second wound wire at least substantially concentrically or may itself surround a second wound wire. Another possibility is that the electrode consists of a wire of which a first layer of turns is made, around which with the same wire a second layer of turns is disposed.

The high-pressure discharge lamp according to the invention may be a high-pressure mercury discharge lamp, for example with the addition of metal halide, or a high-pressure sodium discharge lamp. The lamp vessel may consist of quartz glass or of a crystalline material, such as aluminium oxide or yttrium aluminium garnet. The lamp vessel may be enclosed by an outer envelope.

U.S. Pat. Nos. 2,667,592 and 2,682,007 each describe a short arc discharge lamp, in which the electrodes each consist of a straight tungsten wire, around which thinner wires are wound at a certain distance from its free end. The drawings suggest that the thinner wires of one electrode are the mirror images of those of the other electrode and that they are arranged in the mirror image position of one another. However, this is not stated in the text of these Patent Specifications.

In these known short arc lamps, the distance between the electrodes is equal to the distance between the free ends of the straight tungsten wires. The distance between the thinner wires, which are wound around the electrodes, is consequently considerably larger. In accordance therewith, it is stated in the said Patent Specifications that the discharge arc terminates on the free ends of the straight tungsten wires in the case of stable operation of the lamp. The point of termination of the discharge arc on one electrode is therefore always geometrically identical to the point of termination on the other electrode. Therefore, with straight wire-shaped electrodes, it is not of importance for the possible occurrence of flickering of the lamp whether the wires, which are wound around the electrodes at a considerable distance from their free ends, are wound so as to be the mirror images of one another or whether or not they are arranged in the mirror image positions of one another. The drawings of the said Patent Specifications therefore provide no indication which could have led to the construction of the lamp according to the present invention.

BRIEF DESCRIPTION OF THE DRAWING

Embodiments of the lamp according to the invention are shown in the accompanying drawings. In the drawings.

Figure 1:
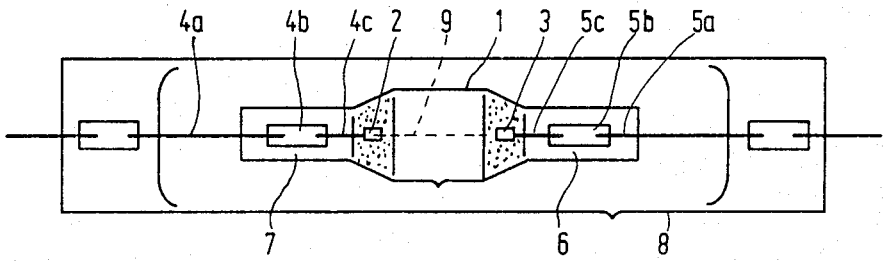
FIG. 1 shows a first embodiment of the high-pressure discharge lamp according to the invention with diagrammatically indicated electrodes.

The high-pressure discharge lamp shown in FIG. 1 has a quartz glass lamp vessel 1 sealed in a vacuum-tight manner and a pair of electrodes 2 and 3 arranged therein, shown diagrammatically, facing each other and disposed at a certain relative distance. The electrodes 2,3 each have a wound wire of mainly tungsten. The distance between these wound wires corresponds to the distance between the electrodes 2,3.

The wall of the lamp vessel 1 is locally formed with pinch seals 6,7, through which current supply conductors 4*a,b,c;* 5*a,b,c* extend to the electrodes 2 and 3, respectively. In the proximity of the electrodes 2,3, the wall of the lamp vessel is coated with zirconium oxide.

The lamp vessel 1 contains an ionizable gas filling of 9 mg of mercury, 200 mbar of rare gas and 2.5 mg of thullium iodide/sodium iodide/thallium iodide in a 1:2:0.2 (mol/mol/mol) ratio. The lamp consumes a power of 150 W.

Figure 3:
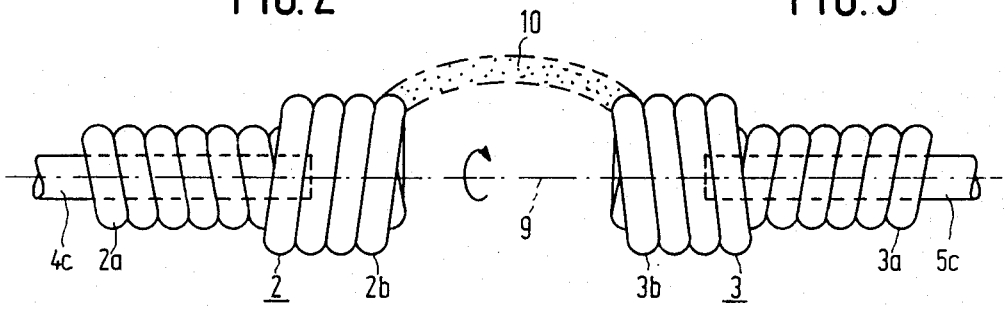
FIG. 3 shows on an enlarged scale the electrodes according to the invention of the lamp in FIG. 1 in their mutual relation.

As appears from FIG. 3, the electrodes 2,3 are the mirror images of one another and are arranged in the mirror image orientations of one another. The electrodes 2,3 are free from material favouring electron emission. When operated in an arbitrary horizontal position, i.e. with a straight line 9 through the electrodes 2,3 in a horizontal plane and with the lamp vessel 1 in an arbitrary rotation about this line, the lamp at least substantially does not flicker. The lamp vessel 1 is disposed with an outer envelope 8.

Figure 2:
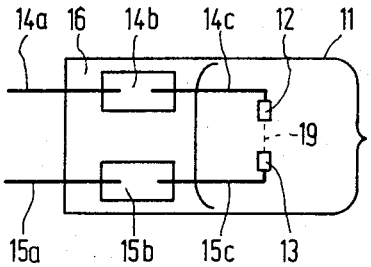
FIG. 2 shows a second embodiment of the high-pressure discharge lamp according to the invention with diagrammatically indicated electrodes.

In FIG. 2, parts corresponding to parts in FIG. 1 have a reference numeral which is 10 higher than in FIG. 1. In contrast with the lamp shown in FIG. 1, the lamp shown in FIG. 2 has only one pinch seal 16. Both current supply conductors 14*a,b,c;* 15*a,b,.c* extend through the wall of the lamp vessel 11. During operation with the line 19 in a horizontal position and with the lamp vessel 11 in an arbitrary rotation about this line 19, the lamp does not, or substantially does not, flicker.

In FIG. 3, the electrodes 2,3 of the lamp shown in FIG. 1 are shown on an enlarged scale in the same mutual relation which they have in the lamp shown in FIG. 1. The electrodes consist of a wound wire 2 and 3, respectively, of mainly tungsten, which is connected at one end to the current supply conductor 4*c* and 5*c,* respectively. They surround an end of the current supply conductor 4*c* and 5*c,* respectively, with clamping fit or are welded thereto. The electrodes 2,3 are free from material favouring electron emission. The distance between the wound wires of the electrodes is the distance between the electrodes 2,3.

The electrodes 2,3 each have a first layer of turns 2*a* and 3*a,* respectively, which pass at the free end of the electrodes 2,3 into a second layer of turns 2*b* and 3*b,* respectively, arranged to surround part of the first layer 2*a* and 3*a,* respectively. The electrodes 2,3 have opposite winding senses, as a result of which they are the mirror images of one another. Therefore, they are not identical Moreover, the electrodes are arranged in the mirror image orientations of one another. In a horizontal position of the electrodes 2,3 i.e. a position in which the straight line 9 through the electrodes 2,3 is horizontal, the discharge arc 10 has the form and the position which are indicated diagrammatically. It appears from the Figure that the point of termination of the discharge arc 10 on the electrode 2 is geometrically identical to the point of termination on the electrode 3. If the lamp with the electrodes 2,3 is rotated about the line 9, the discharge arc 10 is displaced so that it will terminate again at the highest points. However, after this rotation, however large it may be, the discharge arc terminates on each of the electrodes 2,3 again at a geometrically identical point. The voltage drop for the electrode 2, in the half cycle stages in which the electrode 2 acts as the cathode, is consequently of the same value as the voltage drop for the electrode 3 in the half cycles in which the electrode 3 is the cathode. Consequently, flickering of the lamp is effectively avoided.

Figure 4:
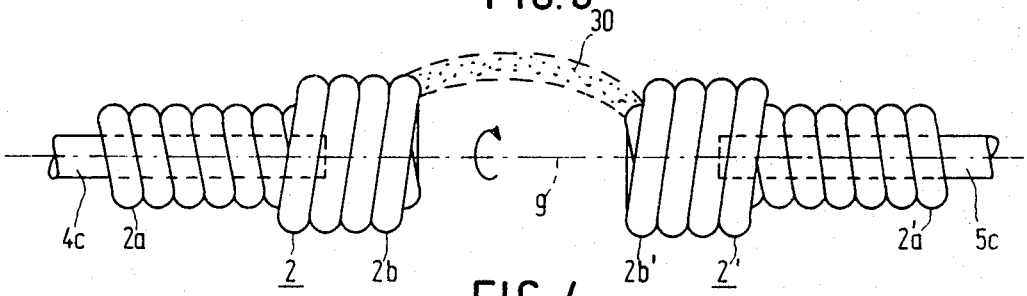
FIG. 4 shows electrodes of a lamp not in accordance with the invention.

FIG. 4 shows for further explanation of the measures according to the invention an electrode 2 identical to the electrode 2 in FIG. 3, and an electrode 2′ also identical to this electrode 2 in FIG. 3. Due to the fact that in the case the electrodes 2 and 2′ are identical to each other, they are not the mirror images of one another and even upon rotation of the electrode 2′ about the line 9 not a single position can be found in which the electrodes 2 and 2′ are arranged in the mirror image position of one another.

In the horizontal position of the line 9 shown in the Figure, the point of termination of the discharge arc 30 on the electrode 2 as shown is a point on an outer turn 2*b* and the point of termination on the electrode 2′ is a point on an inner turn 2*a*′. These points are geometrically greatly different. As a result, their temperatures are different too. When the electrode 2 acts as the cathode, the voltage drop for this electrode is different from that for the electrode 2′ when this electrode is the cathode. A lamp with the electrode 2 and 2′ in the indicated positions flickers during operation in the horizontal operating position.

If the lamp is provided with two identical electrodes 2 and 2′, as in FIG. 4, there are only two positions of rotation about the line 9 in which the points of termination of the discharge arc 30 on the electrode 2 and 2′ are geometrically similar. In the case of the electrodes being arranged as shown in FIG. 4, these positions are the positions which are obtained upon rotation of the electrodes about the line 9 through 90° and through 270°. Even if the electrodes 2 and 2′ happen to be mounted in a predetermined position with respect to the lamp vessel, upon tilting of a luminaire in which this lamp is arranged about an axis parallel to or coinciding with the line 9 a considerable number of positions could be obtained in which the lamp flickers because the points of termination of the discharge arc on the electrodes are geometrically different.

Figure 5:
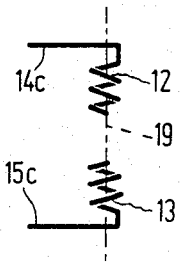
FIG. 5 shows the electrodes of the lamp shown in FIG. 2 on an enlarged scale in their mutual relation.

FIG. 5 shows the electrodes 12 and 13 of the lamp of FIG. 2 on an enlarged scale in their mutual relation. It appears from this Figure that the electrodes 12 and 13 are the mirror images of one another and that they are arranged in the mirror image positions of one another, as a result of which flickering of the lamp during operation in horizontal positions of the line 19 is effectively avoided. The electrodes 12 and 13 each comprise a helically wound wire of mainly tungsten, which is integral with the current supply conductor 14*c* and 15*c,* respectively. The electrodes 12,13 are free from material favouring electron emission.

Figure 6:
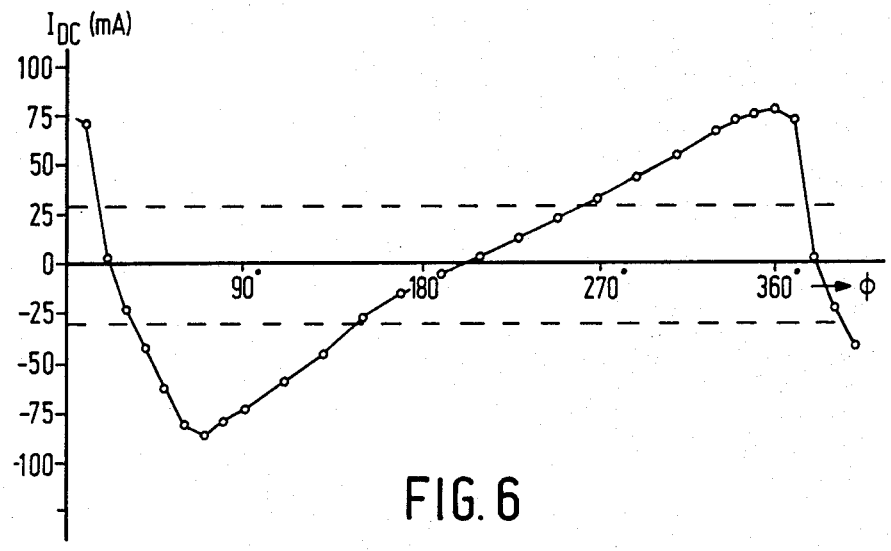
FIG. 6 shows a graph illustrating an electrical current component through a lamp not in accordance with the invention having electrodes as shown in FIG. 4.

FIG. 6 relates to measurements on a lamp having the form of that shown in FIG. 1 with the electrodes of the shape and in the mutual relation of FIG. 4. The lamp vessel 1 was filled with 200 mbar of Ar and 9 mg of Hg. The electrodes 2,2′ consisted of tungsten wire of 350 μm and the current supply conductors 4*c* and 5*c,* respectively, consisted of tungsten wire of 500 μm. The lamp was operated at voltage of 220 V, 50 Hz.

During operation, the lamp was rotated about the horizontal line 9. The difference in the magnitude of current through the lamp in first half cycles of the mains voltage with that in second half cycles is shown as a function of the angle of rotation $\phi$. The value at which 50 % of consulted test persons have experienced, flickering of the lamp as annoying is indicated by two parallel dotted lines. It appears from the Figure that the lamp flickers considerably in most orientations.

Figure 7:
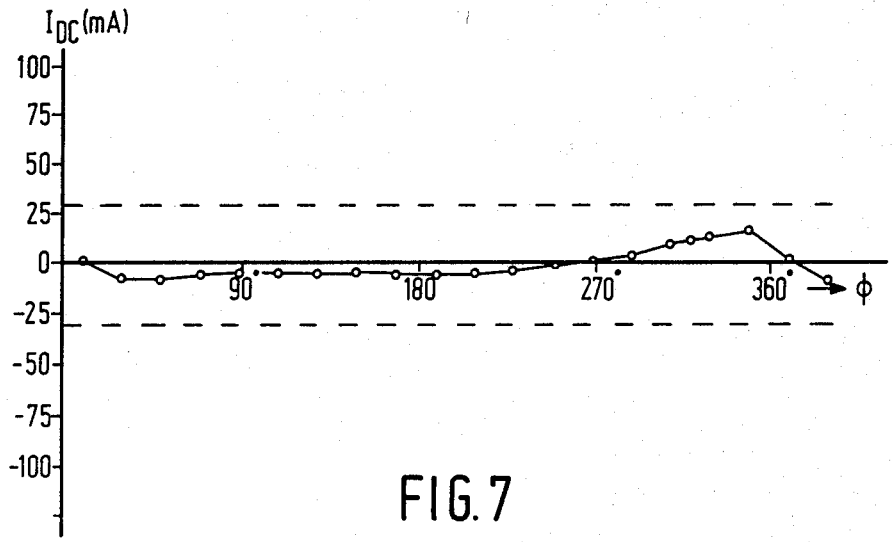
FIG. 7 shows a graph illustrating an electrical current component through a lamp as shown in FIG. 1 having the electrodes as shown in FIG. 3.

FIG. 7 shows a similar graph of the lamp according to the invention which has the electrodes of FIG. 3 in the mutual relation indicated therein, but which is otherwise identical to the lamp to which FIG. 6 relates. It is clearly visible from the Figure that the flickering phenomenon is effectively avoided. The extent of flickering is well below the limit of annoyance indicated by the dotted lines.

What is claimed is:

1. In a high-pressure discharge lamp of the type having a discharge vessel containing an ionizable gas, a pair of discharge electrodes each comprising an electrode coil having an end turn, said electrodes being aligned in said discharge vessel with said turns facing each other so that an arc is maintained between said end turns during lamp operation, said electrode coils being free from material favoring electron emission, and a pair of current-supply conductors for energizing said electrodes, the improvement comprising:

one electrode coil having a first winding sense and the other electrode coil having a winding sense opposite to said first winding sense and said electrodes being oriented with respect to each other so that each end turn is the mirror image of the other end turn.

2. A high-pressure discharge lamp, comprising:

(a) a discharge vessel sealed in a vacuum-tight manner and containing an ionizable gas;

(b) current-supply conductors extending through said discharge vessel;

(c) first and second discharge electrodes connected to respective current-supply conductors, each electrode comprising an electrode coil having a plurality of coil layers, the outermost layer of each electrode coil extending further than any other layer and forming an end turn, each said end turn having the same diameter, and each electrode being free from material favoring electron emission;

one outermost layer having a first winding sense and the other outermost layer having a winding sense opposite to said first winding sense and said electrodes being oriented with respect to each other in said discharge vessel so that each end turn is the mirror image of the other end turn and an arc is maintained between said end turns during lamp operation.

3. A lamp as claimed in claim 2, wherein said each electrode further comprises an electrode rod having a tip end and each coil is secured on a respective rod with said end turns extending past said tip end.

4. A high-pressure discharge lamp, comprising:

(a) a discharge vessel sealed in a vacuum-tight manner containing an ionizable gas;

(b) current-supply conductors extending through said discharge vessel;

(c) first and second discharge electrodes connected to respective current-supply conductors each comprising an elongate electrode rod having a tip end and a two-layer electrode coil disposed on said rod, each electrode being free from material favoring electron emission, and each said electrode coil comprising a length of wire extending helically along the length dimension of said electrode rod toward said rod tip end, said wire extending beyond said tip end and passing into a second layer at an end turn and extending helically away from said tip end along the length dimension of said electrode rod, said wire having a first winding sense on said first discharge electrode and a winding sense opposite to said first winding sense on said second discharge electrode and said electrodes being oriented with respect to each other in said discharge vessel so that each end turn is the mirror image of the other end turn and an arc is maintained between said end turns during lamp operation.

* * * * *

UNITED STATES PATENT AND TRADEMARK OFFICE

CERTIFICATE OF CORRECTION

PATENT NO. : 4,772,822

DATED : September 20, 1988

INVENTOR(S) : VAN DEN NIEUWENHUIZEN ET AL

It is certified that error appears in the above-identified patent and that said Letters Patent is hereby corrected as shown below:

Claim 1, line 5: Insert - - end - - before "turns facing"

Claim 3, line 1: delete - - said - -

Signed and Sealed this

Twenty-fourth Day of October, 1989

*Attest:*

DONALD J. QUIGG

*Attesting Officer*

*Commissioner of Patents and Trademarks*